US008201776B1

(12) United States Patent
Somenzini

(10) Patent No.: US 8,201,776 B1
(45) Date of Patent: Jun. 19, 2012

(54) AIRFOILS AND METHOD FOR CONSTRUCTING AIRFOILS

(75) Inventor: Mario Enrique Somenzini, Champaign, IL (US)

(73) Assignee: Horizon Hobby, Inc., Champaign, IL (US)

( * ) Notice: Subject to any disclaimer, the term of this patent is extended or adjusted under 35 U.S.C. 154(b) by 310 days.

(21) Appl. No.: 12/707,168

(22) Filed: Feb. 17, 2010

(51) Int. Cl.
*B64C 1/00* (2006.01)

(52) U.S. Cl. ..... 244/123.5; 244/123.7

(58) Field of Classification Search ..... 244/123.1, 244/123.7, 123.8, 123.9, 124, 34, 61; 446/88, 446/232, 230
See application file for complete search history.

(56) References Cited

U.S. PATENT DOCUMENTS

| | | | | |
|---|---|---|---|---|
| 2,827,252 | A * | 3/1958 | Pohl | 244/154 |
| 3,273,281 | A | 9/1966 | Harrison | |
| 4,318,516 | A | 3/1982 | Cole | |
| 5,868,092 | A | 2/1999 | Milidragovic | |
| 6,224,451 | B1 * | 5/2001 | Lai | 446/34 |
| 6,425,794 | B1 * | 7/2002 | Levy et al. | 446/34 |
| 7,918,707 | B2 * | 4/2011 | Amireh et al. | 446/58 |
| 2001/0017336 | A1 | 8/2001 | Hirahara et al. | |
| 2010/0193636 | A1 * | 8/2010 | De Vita et al. | 244/123.1 |

OTHER PUBLICATIONS

Parkzone Charge-and-Fly Radio Control Park Flyers webpage for Wing Set: 3D2; web address: http://www.parkzone.com/Products/Default.aspx?ProdID=PKZ4320; dated Feb. 11, 2010.

Toy Sonics.com webpage for Multiplex AcroMaster Kit 43" M214215; web address: http//.www.toysonics.com/multiplex-acromaster-kit-43-m214215.html?printable=Y; dated Feb. 11, 2010.

* cited by examiner

*Primary Examiner* — Joshua J Michener
*Assistant Examiner* — Medhat Badawi
(74) *Attorney, Agent, or Firm* — Suiter Swantz pc llo

(57) ABSTRACT

An airfoil comprising: a foam housing having a leading edge, a trailing edge, a first end, and a second end; a front spar at least generally extending proximal to and along the leading edge; a rear spar at least generally extending proximal to and along the trailing edge; and a center spar assembly located between the front spar and the rear spar, the center spar assembly including: at least one supporting member extending from the first end toward the second end; a sleeve extending from the first end toward the second end, the sleeve configured to receive a joining member; and an anchor positioned adjacent to the first end, the anchor configured for securing an end of the sleeve and an end of each one of the at least one supporting member at the first end.

20 Claims, 11 Drawing Sheets

AIRFOILS AND METHOD FOR CONSTRUCTING AIRFOILS

TECHNICAL FIELD

The disclosure generally relates to the field of airfoil, particularly to an airfoil having internal spars and a method for constructing an airfoil.

BACKGROUND OF THE INVENTION

Airfoils are devices that provide reactive forces when in motion relative to the surroundings. For instance, wings, vertical stabilizers, flying surfaces, sails are some examples of airfoils. Airfoils for model planes, for example, may comprise lightweight materials such as foam materials.

SUMMARY OF THE INVENTION

The present disclosure is directed to an airfoil. The airfoil may comprise a first foam portion for forming a first surface of the airfoil and a second foam portion for forming a second surface of the airfoil. The second foam portion and the first foam portion together define a leading edge, a trailing edge, a first end, and a second end of the airfoil. A front spar and a rear spar are positioned between the first foam portion and the second foam portion, the front spar at least generally extends proximal to and along the leading edge of the airfoil, and the rear spar at least generally extends proximal to and along the trailing edge of the airfoil. A center spar assembly is positioned between the first foam portion and the second foam portion, and the center spar assembly is located between the front spar and the rear spar. The center spar assembly includes: at least one supporting member extending from the first end of the airfoil toward the second end of the airfoil; a sleeve extending from the first end of the airfoil toward the second end of the airfoil, the sleeve configured to receive a joining member inserted through the first end of the airfoil; and an anchor positioned adjacent to the first end of the airfoil, the anchor configured for securing an end of the sleeve and an end of each one of the at least one supporting member at the first end of the airfoil.

A further embodiment of the present disclosure is directed to a method of constructing an airfoil. The method may comprise steps of providing a first portion for forming a first surface of the airfoil, wherein the first portion defines a leading edge, a trailing edge, a first end, and a second end. The first portion may include: a front slot at least generally extending proximal to and along the leading edge, a rear slot at least generally extending proximal to and along the trailing edge, and a center slot located between the front slot and the rear slot. The method may further comprise steps of inserting a front spar into the front slot, inserting a rear spar into the rear slot, and inserting a center spar assembly into the center slot. The center spar assembly includes: at least one supporting member extending from the first end toward the second end; a sleeve extending from the first end toward the second end, the sleeve configured to receive a joining member inserted through the first end; and an anchor positioned adjacent to the first end, the anchor configured for securing an end of the sleeve and an end of each one of the at least one supporting member. The method may further comprise steps of providing a second portion for forming a second surface of the airfoil, wherein the front spar, the rear spar and the center spar assembly are positioned between the first portion and the second portion.

An additional embodiment of the present disclosure is directed to an apparatus. The apparatus may comprise a foam housing having a leading edge, a trailing edge, a first end, and a second end. The apparatus may further comprise a center spar assembly positioned in the foam housing. The center spar assembly includes: at least one supporting member extending from the first end of the foam housing toward the second end of the foam housing; a sleeve extending from the first end of the foam housing toward the second end of the foam housing, the sleeve configured to receive a joining member inserted through the first end of the foam housing; and an anchor positioned adjacent to the first end of the foam housing, the anchor configured for securing an end of the sleeve and an end of each one of the at least one supporting member at the first end of the foam housing.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1:
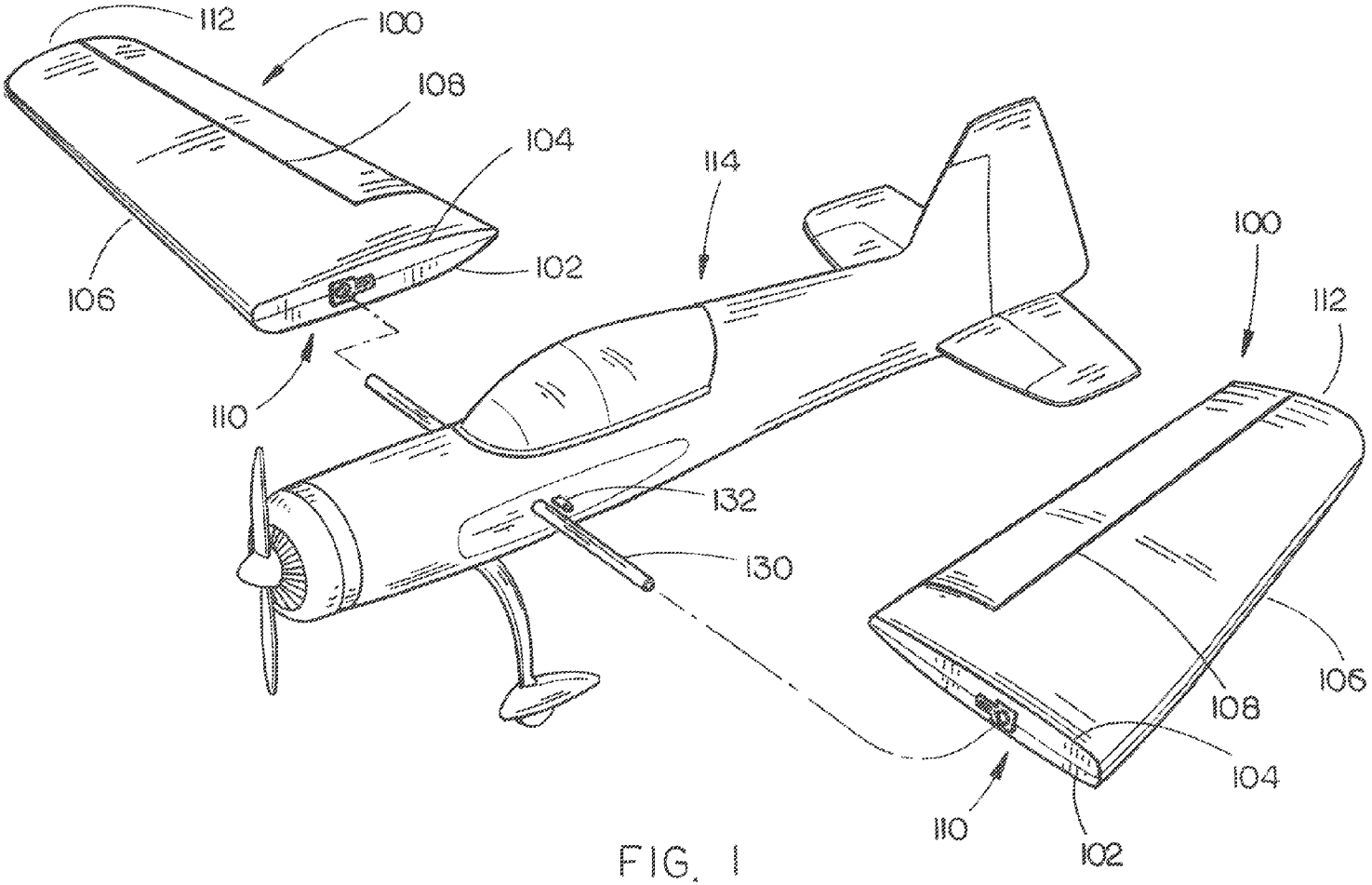
FIG. 1 is an illustration depicting an airfoil of the present disclosure to be coupled to a fuselage of an aircraft.

Reference will now be made in detail to the subject matter disclosed, which is illustrated in the accompanying drawings.

Airfoils for model aircrafts may be constructed utilizing lightweight materials such as foam materials. A foam material may refer to a low/light density substance that is formed by trapping gas bubbles in a solid material. Such substances may include, but are not limited to, XPS foam, polystyrene, EPO, foam rubber, or comparable products and the like. Support structures may be provided to support such lightweight materials.

Referring generally to FIGS. 1 through 7, an airfoil 100 having three internal spars is shown. The airfoil may comprise a foam housing having a first (bottom) portion 102 and a second (top) portion 104. The first portion 102 forms a first surface of the airfoil, and the second portion 104 forms a second surface of the airfoil. The first portion 102 and the second portion 104 together define a leading edge 106, a trailing edge 108, a first end 110, and a second end 112 of the airfoil.

In one embodiment, the airfoil 100 may be configured as a wing structure to be coupled to a fuselage 114 of a model aircraft. The first portion 102 and the second portion 104 may comprise solid lightweight materials such as foam or the like, and the internal spars of the present disclosure are configured for providing support for the airfoil 100 in order to satisfy certain design requirements (e.g., wing span, weight, loading requirements and the like). In this manner, greater wingspans may be achieved by wing structures made of foam materials (e.g., for larger model aircrafts).

In one embodiment, the airfoil 100 comprises a front spar 116, a rear spar 118 and a center spar assembly 120. The front spar 116 is positioned between the first portion 102 and the second portion 104. The front spar 116 is configured to at least generally extend proximal to and along the leading edge 106 of the airfoil 100. The rear spar 118 is also positioned between the first portion 102 and the second portion 104. The rear spar 118 is configured to at least generally extend proximal to and along the trailing edge 108 of the airfoil 100. It is contemplated that grooves 122 may be defined in the first portion 102 and the second portion 104 for receiving the spars. It is also contemplated that adhesives may be applied for securing the spars within the airfoil 100.

The front and rear spars 116 and 118 may comprise natural or composite materials suitable for resisting compressive and/or bending forces, and to provide support for the airfoil 100. In one embodiment, plywood may be utilized for the front and rear spars. The front and rear spars 116 and 118 may be configured in various shapes and forms. For example, the front and rear spars may be configured as elongated members having a rectangular, triangular, circular, or I-shaped cross section or the like. The front and rear spars may also have cutout areas 150 (e.g., apertures) defined so as to reduce the weight (and the material) of the spars while maintaining/increasing their strength.

Figure 4:
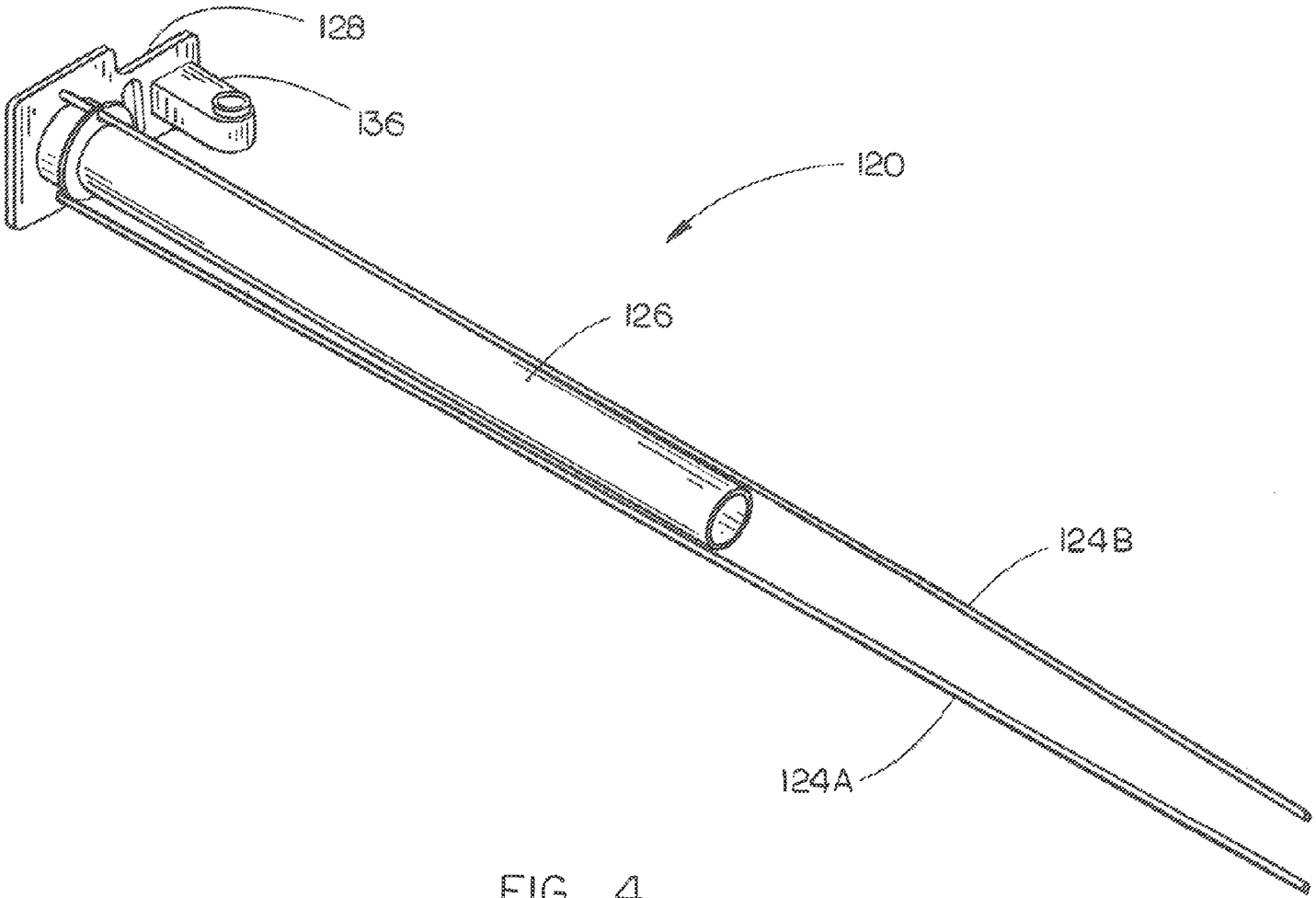
FIG. 4 is an isometric view of a center spar assembly of the airfoil.
Figure 5:
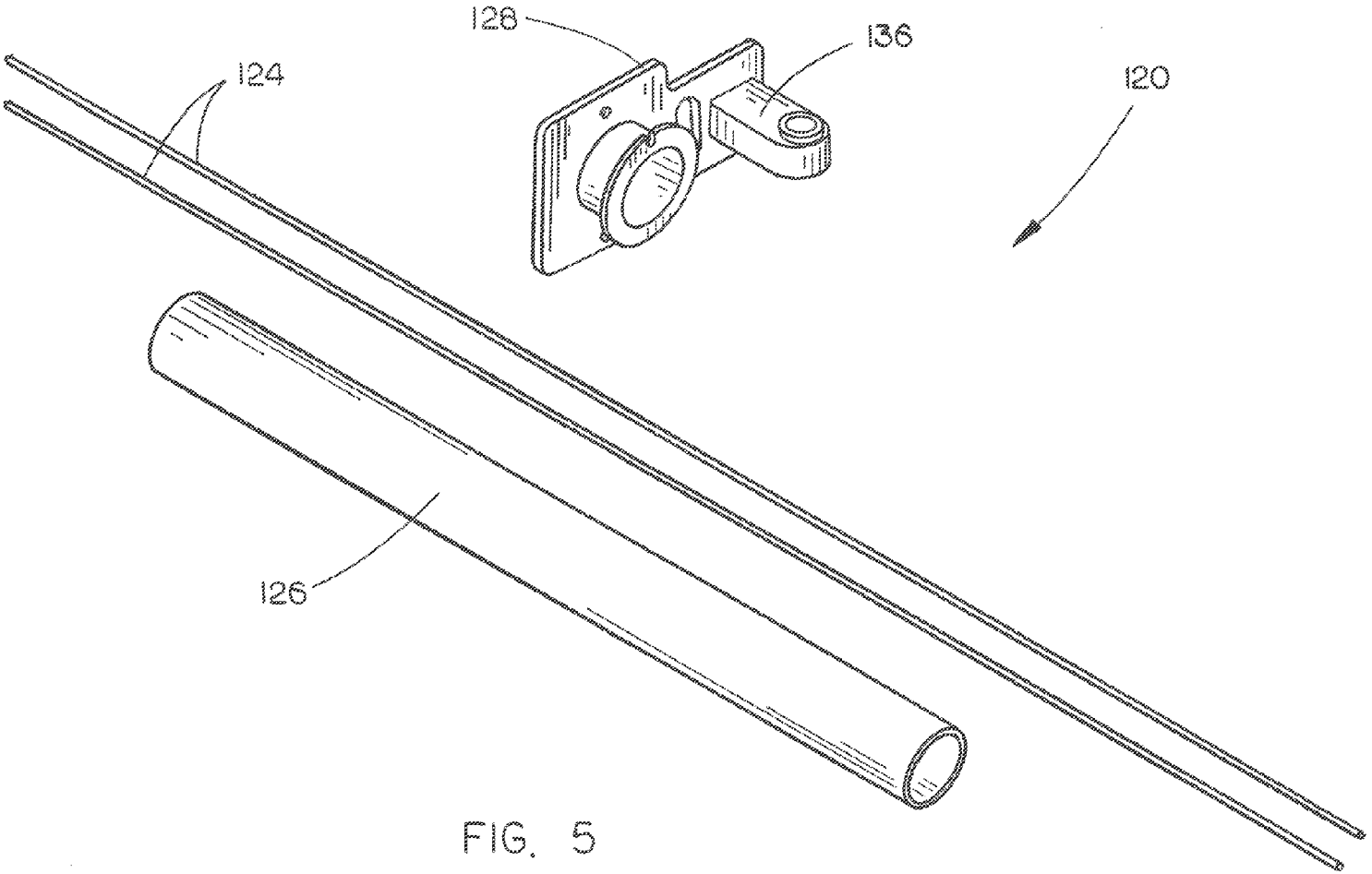
FIG. 5 is an exploded view of the center spar assembly.
Figure 6:
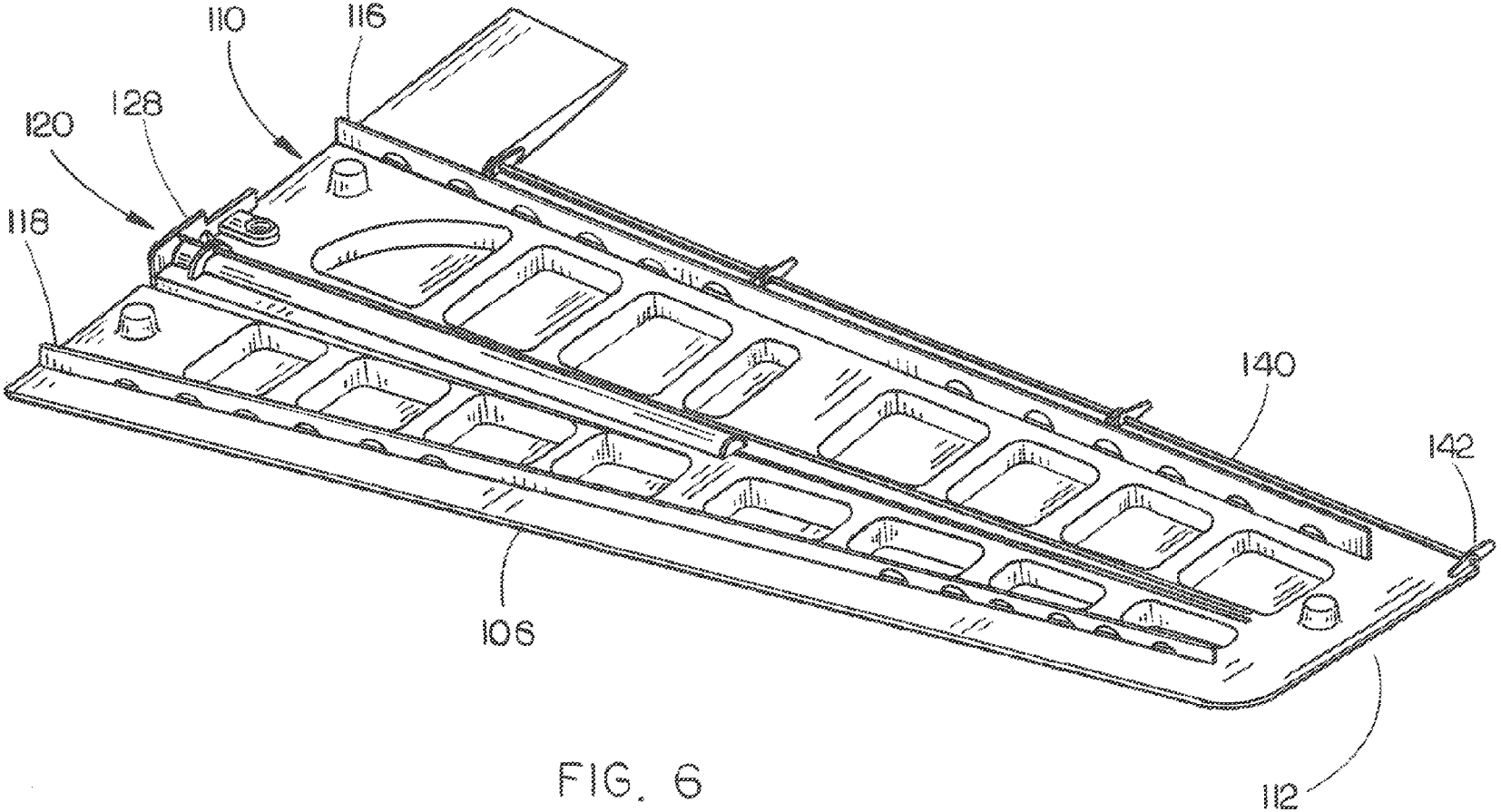
FIG. 6 is an isometric view of the first portion of the airfoil with internal structures attached.

The airfoil 100 further comprises a center spar assembly 120 positioned between the first portion 102 and the second portion 104, and between the front spar 116 and the rear spar 118. As illustrated in FIGS. 4 through 6, the center spar assembly 120 includes one or more supporting member 124, a sleeve 126 for receiving a joining member 130, and an anchor 128 for securing an end of the sleeve 126 and an end of the supporting member 124. Adhesives may be utilized for securing the center spar assembly 120 in the airfoil 100.

The supporting member 124 and the sleeve 126 are configured to extend from the first end 110 of the airfoil 100 toward the second end 112 of the airfoil 100. However, the length of the sleeve 126 may be less than the length of the supporting member 124. For instance, the supporting member 124 may be configured to extend a substantial length from the first end 110 toward the second end 112, while the sleeve 126 may be configured to extend approximately one-half of the length of the supporting member 124. It is understood that the specific length of the supporting member 124 and the sleeve 126 may vary, based upon the design requirements (e.g., wing span, weight, loading requirements and the like) of the airfoil 100. In one embodiment, a length of between 40 and 60 percent of the total airfoil length (the length between the first end 110 and the second end 112) may be suitable for the sleeve 126.

As illustrated in FIG. 6, the anchor 128 is positioned adjacent to the first end 110 of the airfoil 100. The anchor 128 is configured for securing an end of the sleeve 126 and an end of the supporting member 124 at the first end 110 of the airfoil 100. It is contemplated that the sleeve 126 and the supporting member 124 may be coupled to the anchor 128 utilizing various techniques. For example, the anchor 128 may be adhesively coupled to the sleeve 126 and the supporting member 124. In another example, the sleeve 126 and/or the supporting member 124 may be at least partially threaded, allowing the sleeve 126 and/or the supporting member 124 to be screwed onto the anchor 128. It is understood that other techniques such as snap coupling and the like may also be utilized.

The supporting member 124, the sleeve 126, and the anchor 128 may comprise natural or composite materials suitable for resisting compressive and/or bending forces. In one embodiment, carbon fibers may be utilized for the supporting member 124, fiberglass may be utilized for the sleeve 126, and elastomeric polymers (e.g., plastics) may be utilized for forming the anchor 128. The supporting member 124 may be configured as a pole, rod or string in various shapes and/or forms. For example, the supporting member 124 may be configured as a rod having a rectangular, square, triangular, or circular cross section or the like.

In one embodiment, the center spar assembly 120 may include a single supporting member 124 positioned in a groove located in the first portion 102 of the airfoil 100. The single supporting member configuration may be appreciated in airfoil designs that perform under generally positive g-force or light negative g-force (e.g., airfoils used on a glider and the like). In another embodiment, the center spar assembly 120 may include two supporting members 124. One of the supporting members may be positioned in a groove located in the first portion 102 of the airfoil 100, and the other supporting member may be positioned in a groove located in the second portion 104 of the airfoil 100. In this manner, the two supporting members may provide strength to the airfoil 100 under both positive and/or negative g-forces. It is understood that the center spar assembly 120 may include additional supporting members without departing from the spirit and scope of the present disclosure.

Figure 8:
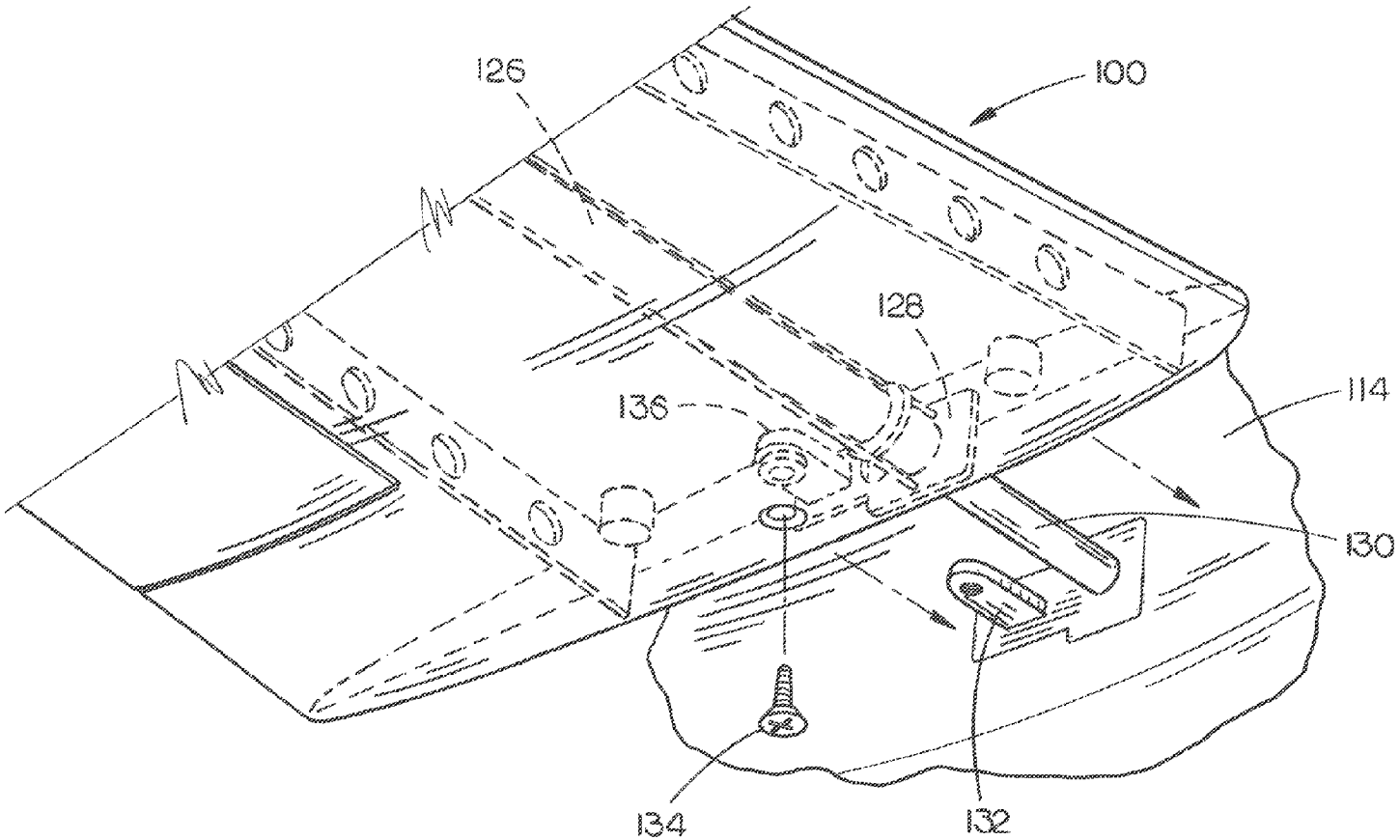
FIG. 8 is an illustration depicting the airfoil being coupled to the fuselage of the aircraft.
Figure 9:
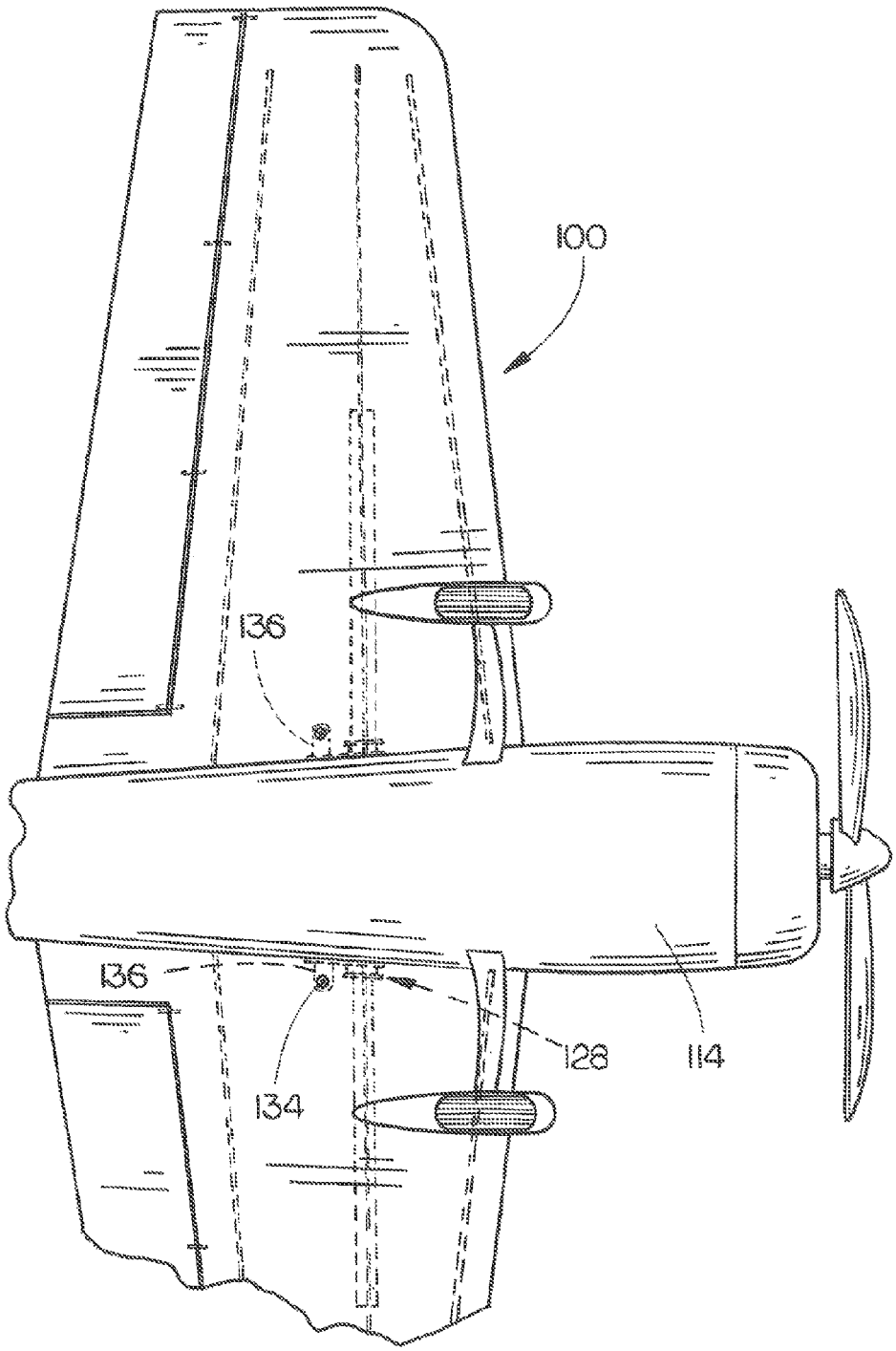
FIG. 9 is a partial bottom view of the aircraft, wherein the internal structures of the airfoils are illustrated.
Figure 10:
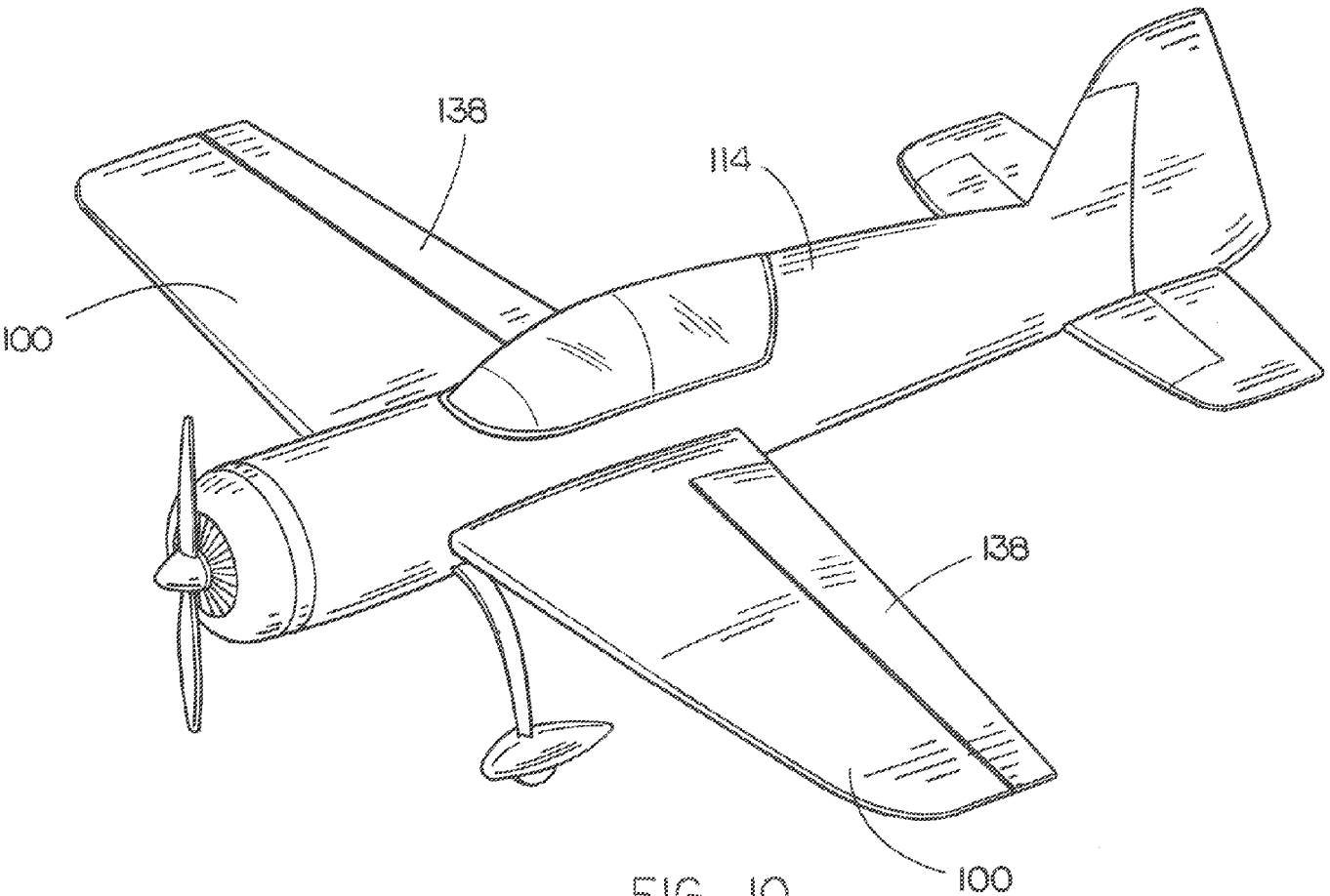
FIG. 10 is an isometric view of the aircraft having the airfoils attached.

FIGS. 8 through 10 depict the airfoil 100 being coupled to the fuselage 114. In one embodiment, the fuselage 114 may comprise a joining member 130 extending generally outwardly for inserting through the anchor 128 and into the sleeve 126 of the center spar assembly 120. For example, the joining member 130 may be a carbon fiber tube having an outer circumference slightly smaller than and generally coincide with the inner circumference of the sleeve 126. The joining member 130 may be configured to extend the length of the sleeve 126 partially or entirely when the joining member 130 is at a fully inserted position. Though the sleeve 126 and the joining member 130 as depicted in the figures generally comprise a circular cross section, it is understood that other cross sectional configurations may be utilized without departing from the spirit and scope of the present disclosure.

It is contemplated that the anchor 128 may further comprise a receiving member 136 (e.g., a cavity defined in the anchor). The receiving member 136 may be configured for receiving an insert 132 located on the fuselage 114 proximal to the joining member 130. The insert 132 and the joining member 130 together may define an orientation of which the airfoil 100 may be coupled to the fuselage 114. It is contemplated that various securing mechanisms may be utilized for coupling the insert 132 and the receiving member 136. In one example, as illustrated in FIG. 8, the insert 132 and the receiving member 136 may each contain a threaded hole that aligns with each other when the insert 132 is fully inserted into the receiving member 136. In this manner, a screw/bolt 134 may be utilized to secure the insert 132 in the receiving member 136 (e.g., the screw may insert through an opening in the airfoil surface and engage both the receiving member 136 and the insert 132 via the threaded holes). In another example, adhesives may be applied to adhesively secure the insert 132 and the receiving member 136. It is understood that other securing mechanisms such as snap coupling and the like may also be utilized.

Figure 2:
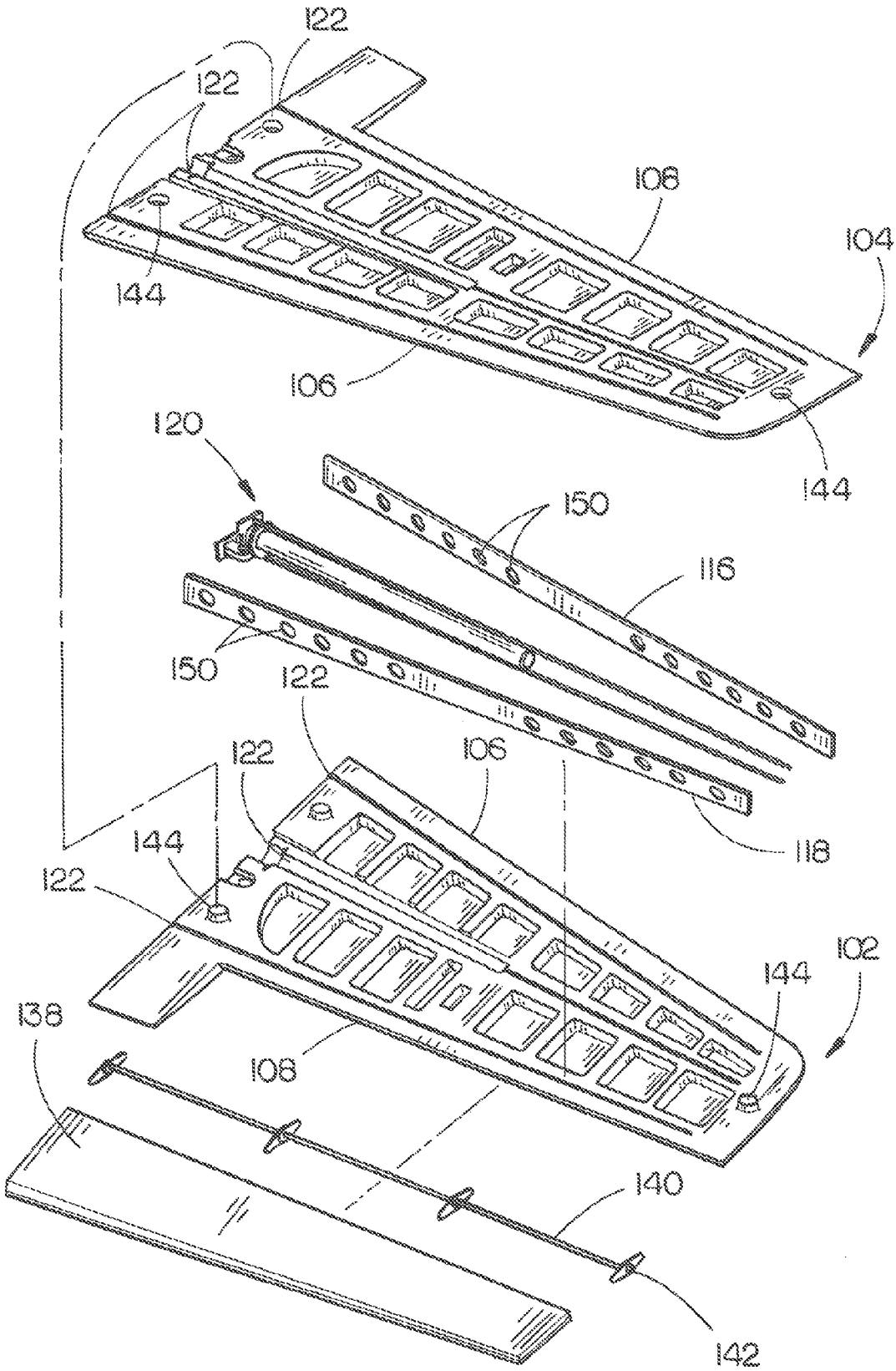
FIG. 2 is an exploded view of the airfoil.

Referring now to FIGS. 2 and 6, the airfoil 100 may further comprise an aileron 138. In one embodiment, a hinge system may be utilized for attaching the aileron 138 at the trailing edge 108 of the airfoil 100. The hinge system may comprise a plurality of hinge blades 142 connected by a rod 140 generally extending along the trailing edge 108 of the airfoil. Each hinge blade 142 may have an end attached to the trailing edge 108 of the airfoil and an opposite end attached to the aileron 138. In this manner, the aileron 138 may pivot, relative to the airfoil 100, about the axis defined by the rod 104. It is understood that other mechanisms may be utilized for attaching the aileron 138 to the airfoil.

Figure 3:
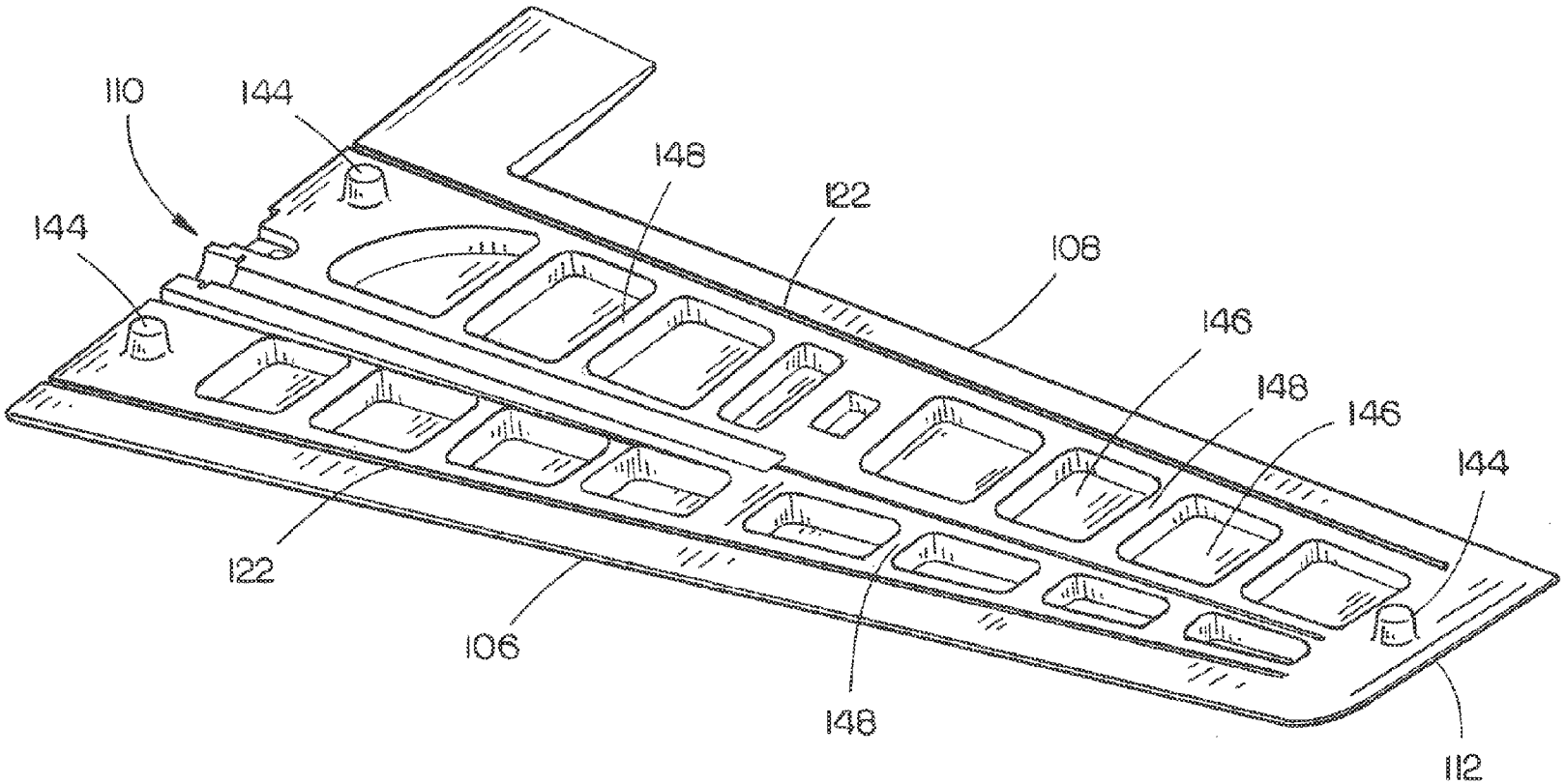
FIG. 3 is an isometric view of a first portion of the airfoil.
Figure 7:
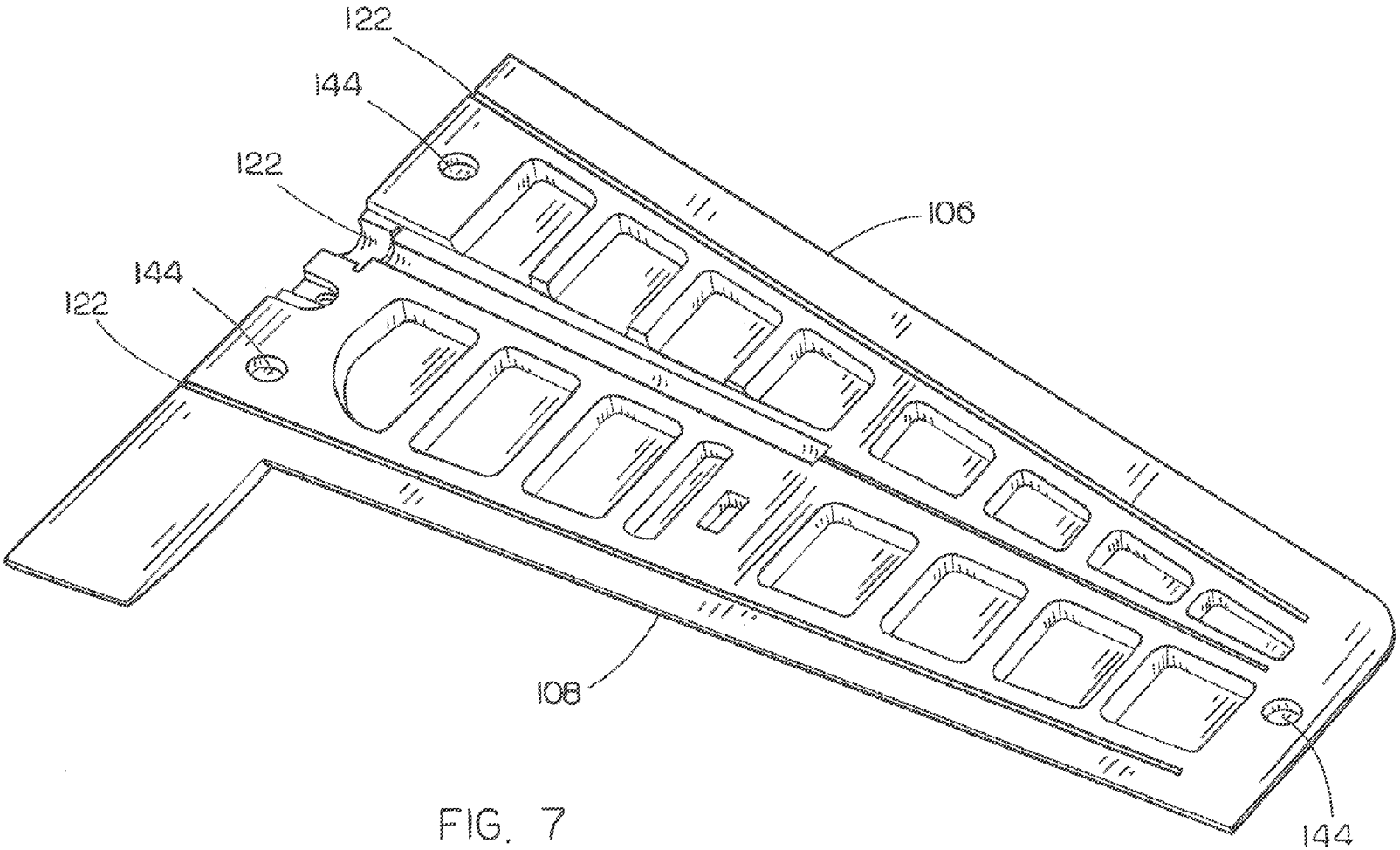
FIG. 7 is an isometric view of the second portion of the airfoil.

It is contemplated that the first and second portions 102 and 104 of the airfoil 100 may further comprise one or more pairs of self-aligning guides 144 as illustrated in FIGS. 3 and 7. In one embodiment, three pairs of self-aligning guides 144 may be utilized, and each pair of the self-aligning guides 144 may include a raised segment located on one of the first portion 102 or the second portion 104, and a corresponding recessed segment located on the other portion for aligning with the raised segment. It is appreciated that such self-aligning guides may also provide additional bonding surfaces (e.g., for applying adhesives) between the first portion 102 and the second portion 104. It is also understood that other self-aligning mechanisms such as tracks and/or keyways may be utilized.

It is further contemplated that the first portion 102 and/or the second portion 104 may include cavities 146 for defining ribs 148 that are internal to the airfoil 100 as illustrated in FIGS. 3 and 7. In one embodiment, the ribs defined in the first portion 102 generally correspond to the ribs defined in the second portion 104 when the two portions (102 and 104) are aligned, forming the internal ribs structure for the airfoil 100. In this manner, less material may be required for constructing the airfoil 100 (and therefore less weight) without compromising the strength and the rigidity of the airfoil 100 (and in certain configurations the ribs may add strength and rigidity to the airfoil).

Figure 11:
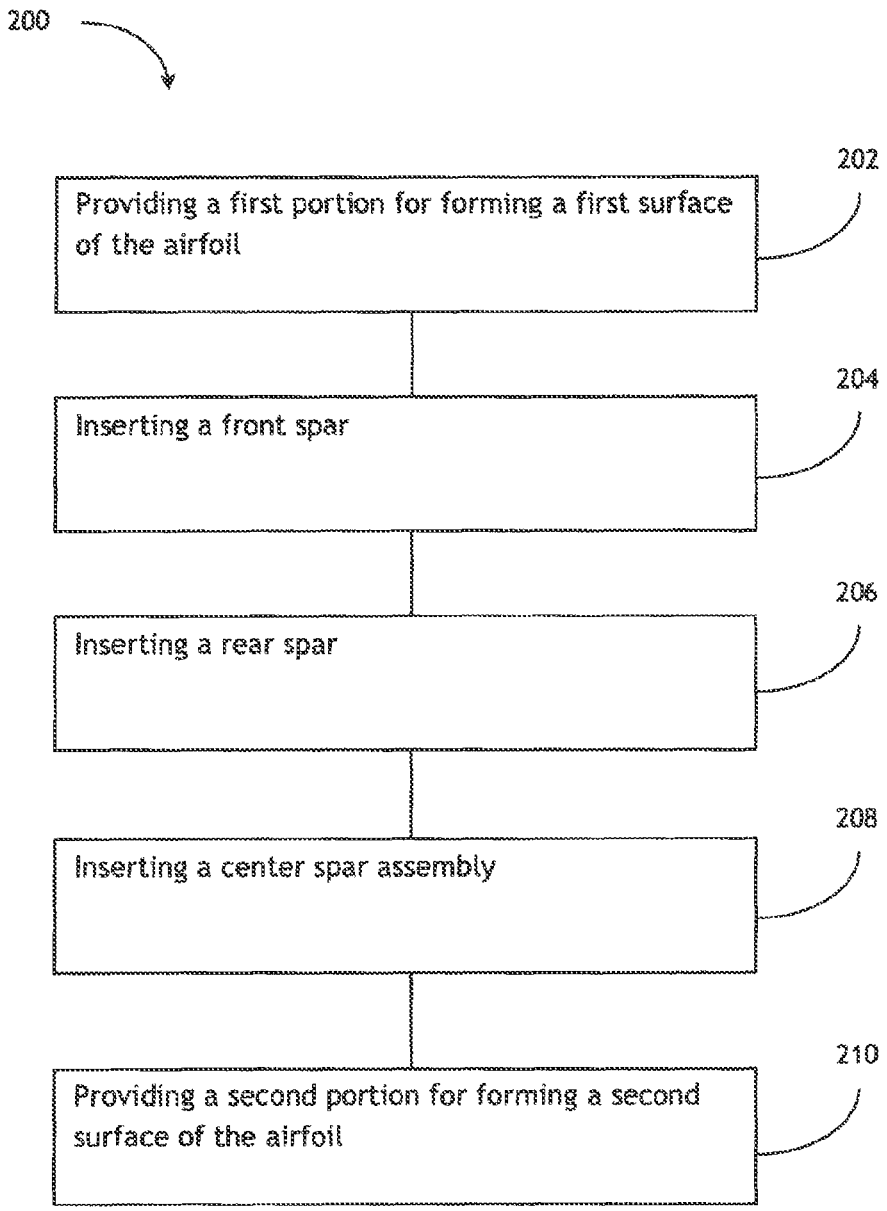
FIG. 11 is a flow diagram illustrating a method for constructing an airfoil.

Referring now to FIG. 11, there is shown a flow diagram illustrating a method 200 for constructing an airfoil. Step 202 provides a first portion for forming a first surface of the airfoil. The first portion defines a leading edge, a trailing edge, a first end, and a second end. In one embodiment, the first portion may include a front slot for receiving a front spar, a rear slot for receiving a rear spar, and a center slot located between the front slot and the rear slot for receiving a center spar assembly. The front slot generally extends proximal to and along the leading edge, and the rear slot generally extends proximal to and along the trailing edge.

The front spar (as previously described) is inserted into the front slot in step 204. It is understood that adhesives may be applied for securing the front spar in the front slot. Similarly, the rear spar is inserted into the rear slot in step 206, and adhesives may be applied for securing the rear spar in the rear slot.

The center spar assembly (as previously described) is inserted into the center slot in step 208. The center spar assembly, including one or more supporting members, a sleeve and an anchor, may be pre-assembled and inserted into to the center slot as one unit. Alternatively, the center spar assembly may be assembled during the construction of the airfoil. For example, in a two-supporting member center spar assembly configuration as illustrated in FIGS. 4 through 6, the first supporting member 124A may be placed into the center slot first, followed by the placement of the sleeve 126. The anchor 128 may be coupled with an end of the first supporting member 124A and an end of the sleeve 126. An end of the second supporting member 124B may then be coupled with the anchor 128 and placed above the sleeve 126 to complete the center spar assembly. It is understood that adhesives may be applied at various locations for securing the center spar assembly. For example, adhesives may be applied to at least parts of the surfaces of the first supporting member 124A and/or the anchor 128 facing the first portion, so as to adhesively attaching the first supporting member 124A and/or the anchor 128 to the first portion of the airfoil.

It is understood that additional airfoil components may be attached. For example, the hinge system utilized for attaching an aileron may be attached. In one embodiment, the hinge system may include a plurality of hinge blades connected by a rod generally extending along the trailing edge. Each hinge blade may have an end attached to the trailing edge of the first portion and an opposite end for receiving the aileron. It is understood that other mechanisms may be utilizing for attaching the aileron to the airfoil. It is also understood that additional components may be attached to the airfoil without departing from the spirit and scope of the present disclosure.

Once the internal structure of the airfoil is constructed, step 210 provides a second portion for forming a second surface of the airfoil. The second portion is aligned with the first portion to form a housing, wherein the front spar, the rear spar, and the center spar assembly are located in this housing. It is understood that adhesives may be utilized for securely coupling the first and second portions and the structures enclosed therein. For example, adhesives may be applied to at least parts of the surfaces of the second supporting member 124B and/or the anchor 128 facing the second portion, so as to adhesively attaching the second supporting member 124B and/or the anchor 128 to the second portion of the airfoil. Adhesives may also be applied to the contacting surfaces between the first and second portions, including the self-aligning guides as previously described.

It is contemplated that various other methods may be utilized for constructing/manufacturing the airfoil of the present disclosure. For example, in addition or alternative to applying adhesives, other coupling mechanisms (e.g., screws, bolts, or snap coupling devices) may be utilized for securely coupling the first and second portions of the airfoil as well as the structures enclosed therein. It is also contemplated that the first and/or the second portions of the airfoil themselves may comprise multiple segments, which may be produced/handled separately and joined together during the airfoil assembling process. It is further contemplated that the airfoil may be constructed utilizing an injection molding process or the like, wherein the internal structures (the spars and/or the hinge system, etc) may be configured in a mold cavity, and the materials for forming the airfoil surfaces may be injected into the mold cavity to form a housing containing the internal structures.

It is understood that the airfoil of the present disclosure is not limited to a wing structure for coupling to an aircraft fuselage. For example, vertical stabilizers, flying surfaces, sails, propeller blades, rudders and the like may be configured and/or manufactured as described above.

The methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the disclosure. The accompanying method claims present elements of the various steps in a sample order, and are not necessarily meant to be limited to the specific order or hierarchy presented.

It is believed that the system and method of the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

What is claimed is:

1. An airfoil comprising:

a first foam portion for forming a first surface of the airfoil;

a second foam portion for forming a second surface of the airfoil, the second foam portion and the first foam portion together defining a leading edge, a trailing edge, a first end, and a second end of the airfoil;

a front spar positioned between the first foam portion and the second foam portion, the front spar at least generally extending proximal to and along the leading edge of the airfoil;

a rear spar positioned between the first foam portion and the second foam portion, the rear spar at least generally extending proximal to and along the trailing edge of the airfoil; and a center spar assembly positioned between the first foam portion and the second foam portion, the center spar assembly located between the front spar and the rear spar, the center spar assembly comprising:

at least one supporting member extending from the first end of the airfoil toward the second end of the airfoil;

a sleeve extending from the first end of the airfoil toward the second end of the airfoil, the sleeve configured to receive a joining member inserted through the first end of the airfoil, the length of the sleeve being less than the length of the at least one supporting member; and an anchor positioned adjacent to the first end of the airfoil, the anchor configured for securing an end of the sleeve and an end of each one of the at least one supporting member at the first end of the airfoil.

2. The airfoil of claim 1, wherein the center spar assembly comprises two supporting members extending from the first end of the airfoil toward the second end of the airfoil, a first of the two supporting members being positioned within the first foam portion of the airfoil, and a second of the two supporting members being positioned within the second foam portion of the airfoil.

3. The airfoil of claim 1, wherein at least one of the first portion and the second portion comprise rib-defining cavities.

4. The airfoil of claim 1, wherein the first portion and the second portion comprise at least one pair of self-aligning guides for facilitating alignment of the first foam portion and the second foam portion.

5. The airfoil of claim 1, further comprising a hinge system positioned at the trailing edge of the airfoil for receiving an aileron.

6. The airfoil of claim 1, wherein the anchor defines a receiving member for receiving an insert located proximal to the joining member.

7. The airfoil of claim 1, wherein the front spar and the rear spar comprise plywood.

8. The airfoil of claim 1, wherein the at least one supporting member comprises carbon fiber.

9. The airfoil of claim 1, wherein the sleeve comprises fiberglass material.

10. The airfoil of claim 1, wherein the anchor comprises elastomeric polymer material.

11. A method of constructing an airfoil, comprising:

providing a first portion for forming a first surface of the airfoil, the first portion comprising a leading edge, a trailing edge, a first end, and a second end, the first portion having a front slot at least generally extending proximal to and along the leading edge, the first portion having a rear slot at least generally extending proximal to and along the trailing edge, and the first portion having a center slot located between the front slot and the rear slot;

inserting a front spar into the front slot;

inserting a rear spar into the rear slot;

inserting a center spar assembly into the center slot, the center spar assembly comprising:

at least one supporting member extending from the first end toward the second end;

a sleeve extending from the first end toward the second end, the sleeve configured to receive a joining member inserted through the first end, the length of the sleeve being less than the length of the at least one supporting member; and an anchor positioned adjacent to the first end, the anchor configured for securing an end of the sleeve and an end of each one of the at least one supporting member; and providing a second portion for forming a second surface of the airfoil, wherein the front spar, the rear spar and the center spar assembly are positioned between the first portion and the second portion.

12. The method of constructing an airfoil of claim 11, wherein the center spar assembly comprises two supporting members extending from the first end of the airfoil toward the second end of the airfoil, a first of the two supporting members being positioned within the first portion of the airfoil, and a second of the two supporting members being positioned within the second portion of the airfoil.

13. The method of constructing an airfoil of claim 11, wherein at least one of the first portion and the second portion comprise rib-defining cavities.

14. The method of constructing an airfoil of claim 11, wherein the first portion and the second portion comprise at least one pair of self-aligning guides for facilitating alignment of the first portion and the second portion.

15. The method of constructing an airfoil of claim 11, further comprising:

placing a hinge system at the trailing edge of the airfoil for receiving an aileron.

16. The method of constructing an airfoil of claim 11, wherein the anchor defines a receiving member for receiving an insert located proximal to the joining member.

17. The method of constructing an airfoil of claim 11, wherein the first portion and the second portion comprise foam material, the front spar and the rear spar comprise plywood, the at least one supporting member comprises carbon fiber, the sleeve comprises fiberglass material, and the anchor comprises elastomeric polymer material.

18. An apparatus comprising:

a foam housing having a leading edge, a trailing edge, a first end, and a second end; and a center spar assembly positioned in the foam housing, the center spar assembly comprising:

at least one supporting member extending from the first end of the foam housing toward the second end of the foam housing;

a sleeve extending from the first end of the foam housing toward the second end of the foam housing, the sleeve configured to receive a joining member inserted through the first end of the foam housing, the length of the sleeve being less than the length of the at least one supporting member; and an anchor positioned adjacent to the first end of the foam housing, the anchor configured for securing an end of the sleeve and an end of each one of the at least one supporting member at the first end of the foam housing.

19. The apparatus of claim 18, further comprising:

a front spar positioned in the foam housing, the front spar extending proximal to and along the leading edge of the foam housing; and a rear spar positioned in the foam housing, the rear spar extending proximal to and along the trailing edge of the foam housing;

wherein the center spar assembly is configured to be located between the front spar and the rear spar.

20. The apparatus of claim 18, further comprising:

a hinge system positioned at the trailing edge of the foam housing for receiving an aileron.

* * * * *